US008506238B2

(12) United States Patent
Slike et al.

(10) Patent No.: US 8,506,238 B2
(45) Date of Patent: Aug. 13, 2013

(54) WATER PUMP WITH HOUSING/IMPELLER TO ENHANCE SEAL PERFORMANCE

(75) Inventors: Jody Slike, Farmington Hills, MI (US); Patrick Hertrich, Novi, MI (US); Paul Po-Wen Yu, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 2003 days.

(21) Appl. No.: 11/308,339

(22) Filed: Mar. 16, 2006

(65) Prior Publication Data

US 2007/0217907 A1 Sep. 20, 2007

(51) Int. Cl.
*F01D 3/00* (2006.01)

(52) U.S. Cl.
USPC ..... 415/106; 415/172.1; 415/206

(58) Field of Classification Search
USPC ..... 415/112, 111, 106, 180, 172.1, 206
See application file for complete search history.

(56) References Cited

U.S. PATENT DOCUMENTS

| | | | | |
|---|---|---|---|---|
| 4,773,823 | A | 9/1988 | Pease | |
| 5,156,522 | A | 10/1992 | Tessier | |
| 5,195,867 | A * | 3/1993 | Stirling | 415/111 |
| 5,355,847 | A | 10/1994 | Ozeki | |
| 5,489,187 | A * | 2/1996 | Ray | 415/111 |
| 5,713,719 | A | 2/1998 | Fiore et al. | |
| 5,718,436 | A | 2/1998 | Dunford | |
| 5,827,041 | A | 10/1998 | Charhut | |
| 6,402,461 | B1 | 6/2002 | Tebby | |
| 6,752,590 | B2 | 6/2004 | Serio | |
| 2005/0152786 | A1 * | 7/2005 | Ro et al. | 416/242 |

FOREIGN PATENT DOCUMENTS

JP 1997-0088886 3/1997

OTHER PUBLICATIONS

Sasaki Noreo; Patent Abstracts of Japan; Pub. No. 09-088886; Mar. 31, 1997.

* cited by examiner

*Primary Examiner* — Dwayne J White
(74) *Attorney, Agent, or Firm* — Julia Voutyras; Brooks Kushman P.C.

(57) ABSTRACT

Systems and methods for improving seal performance in a centrifugal water pump for an internal combustion engine increase static pressure at the seal by incorporating a combination of slots and ribs into a seal cavity of the pump housing that are positioned to convert dynamic fluid pressure into static pressure at the seal while reducing coolant velocity at the seal. Vent holes in the impeller having an appropriate size and location may also be used to increase the static pressure at the seal to enhance seal performance.

19 Claims, 9 Drawing Sheets

WATER PUMP WITH HOUSING/IMPELLER TO ENHANCE SEAL PERFORMANCE

BACKGROUND OF THE INVENTION

1. Field of the Invention

The present invention relates to systems and methods for enhancing water pump seal performance in a water/coolant pump for an internal combustion engine.

2. Background Art

Internal combustion engines typically have a liquid cooling system that uses a water pump to circulate engine coolant between a radiator and the cooling water jacket of the engine. A typical centrifugal water pump consists of a shaft mounted impeller rotatable inside a housing. The shaft is substantially part of an integrated shaft bearing which is pre-lubricated and located in an environment free of debris and coolant. A mechanical seal with sliding faces is disposed about the shaft and mounted in the housing inside a seal cavity behind the impeller to prevent leakage of coolant into the area where the bearings support the shaft and/or outside of the housing. The mechanical seal relies on a lubricating fluid film to inhibit or prevent deterioration of the sliding faces by separating the faces and providing cooling. Static pressure at the seal may facilitate exchange of thermal energy between the sealing surfaces and surrounding fluid by maintaining the fluid in the liquid phase. Vaporization at the sealing surfaces can lead to contact between the seal faces, causing early wear and adversely affecting desired seal performance. Similarly, any debris and/or contaminants in the water/coolant may collect in the seal cavity and lead to scoring of sealing surfaces resulting in fluid leakage past the seal.

U.S. Pat. Nos. 5,713,719 and 5,355,847 disclose water pump features designed to increase the coolant velocity at the seal to flush debris and cool the seal, or to increase structural integrity of the pump. However, the present inventors have recognized that increasing coolant velocity at the seal alone will not necessarily improve seal performance, and may actually adversely affect seal performance. The present inventors have recognized that prior art water pumps do not recognize the role of static pressure and coolant velocity at the seal relative to seal performance.

SUMMARY OF THE INVENTION

The present invention provides systems and methods for improving seal performance by increasing static pressure within a seal cavity of the housing of a centrifugal water pump for an internal combustion engine. Embodiments of the invention use impeller and seal cavity design features positioned to convert dynamic or total pressure into static pressure at the seal while also reducing coolant velocity at the seal.

In one embodiment, design features on the impeller include a plurality of generally circular openings or vent holes that allow coolant to pass from the seal cavity to the lower pressure environment on the front side of the impeller, and carry with it any formed vapors. The design features of the housing within the seal cavity may include a combination of one or more slots and one or more ribs. The slots are positioned to increase static pressure at the seal, preferably within the first thirty degrees prior to the pump outlet(s) measured in the direction of impeller rotation. The slots also promote axial flow motion to purge vapors from the cavity. Ribs increase the static pressure at the seal by disrupting the circular flow pattern induced by rotational impeller motion during operation. The ribs are positioned preferably within the first thirty degrees after the pump outlet(s) and then again at a position based on the pump configuration, which separates the ribs by ninety degrees in one embodiment.

In one embodiment of the invention, the openings on the impeller comprise a plurality of generally round holes. The hole diameter may be selected to allow coolant and any vapor to flow between the seal cavity and the vane side of the impeller based on the pressure differential created during operation. The water pump housing includes a combination of a plurality of radially straight slots and ribs. In another embodiment of the invention, the housing includes radially straight ribs, and slots that curve in the direction of impeller rotation.

The present invention provides a number of advantages. For example, the present invention recognizes the effect of static pressure in the seal environment on seal performance and enhances seal performance by increasing static pressure at the seal relative to prior art designs. The present invention reduces coolant velocity at the seal, which increases static pressure and enhances seal performance. Positioning of ribs in the pump housing inside the seal cavity according to the present invention disrupts the induced circular coolant flow pattern and lowers coolant velocity at the seal to enhance seal performance. Use of design features, such as ribs and slots, within the seal cavity according to the present invention improves robustness of the pump assembly in that the pressure rise from the inlet to the stationary part of the seal is less sensitive to axial distance between the impeller and housing due to manufacturing/assembly tolerances and/or movement during operation.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present invention as illustrated and described with reference to any one of the Figures may be combined with features illustrated in one or more other Figures to produce embodiments of the present invention that are not explicitly illustrated or described. The combinations of features illustrated provide representative embodiments for typical applications. However, various combinations and modifications of the features consistent with the teachings of the present invention may be desired for particular applications or implementations.

Figure 1:
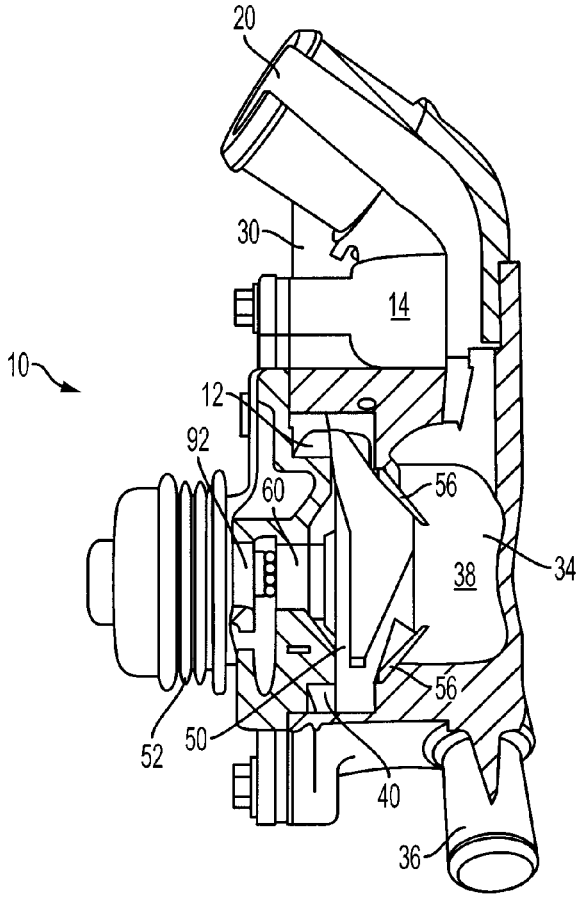
FIG. 1 is a cut-away view of a centrifugal water pump assembly according to one embodiment of the present invention used in a representative automotive internal combustion engine application.

Referring now to FIG. 1, a cut-away view of a centrifugal water pump assembly 10 for an automotive internal combustion engine application includes a housing cover 12 secured to a housing base 14 by a plurality of fasteners. Depending on the particular application and implementation, the housing base and/or cover may be integrally formed within another engine component, such as the engine block, for example, rather than combining to form a separate component as illustrated in FIG. 1. Housing base 14 includes an inlet 20 and outlet 30 fluidly coupled via a fluid chamber 34 that includes a reservoir region 38 separated from an annular pumping region 40 surrounding impeller 50 by a shroud 56. In the illustrated embodiment, a heater return 36 is also fluidly coupled to chamber 34 and returns water/coolant to assembly 10 from a vehicle heater circuit (not shown). Impeller 50 is mounted on a rotatable shaft 90 (FIG. 2), which is supported by a sealed bearing assembly 92 mounted in cover 12, and extends into housing base 14. A mechanical seal 60 is mounted in cover 12 and operates to seal chamber 34 and maintain substantially all water/coolant within assembly 10 and away from bearing assembly 92. A drive device, such as pulley 52, is also mounted on shaft 90 (FIG. 2) and may be driven by an accessory belt (not shown), chain, shaft, etc. to rotate impeller 50 during operation. Various other alternative driving configurations may also be used to rotate to the bearing shaft. Cooled water/coolant from a vehicle radiator (not shown) enters water pump assembly 10 from inlet 20 (and from heater return 36) and is pumped by centrifugal force produced by rotating impeller 50 to outlet 30 to enter the cooling water jacket of the engine (not shown).

Figure 2:
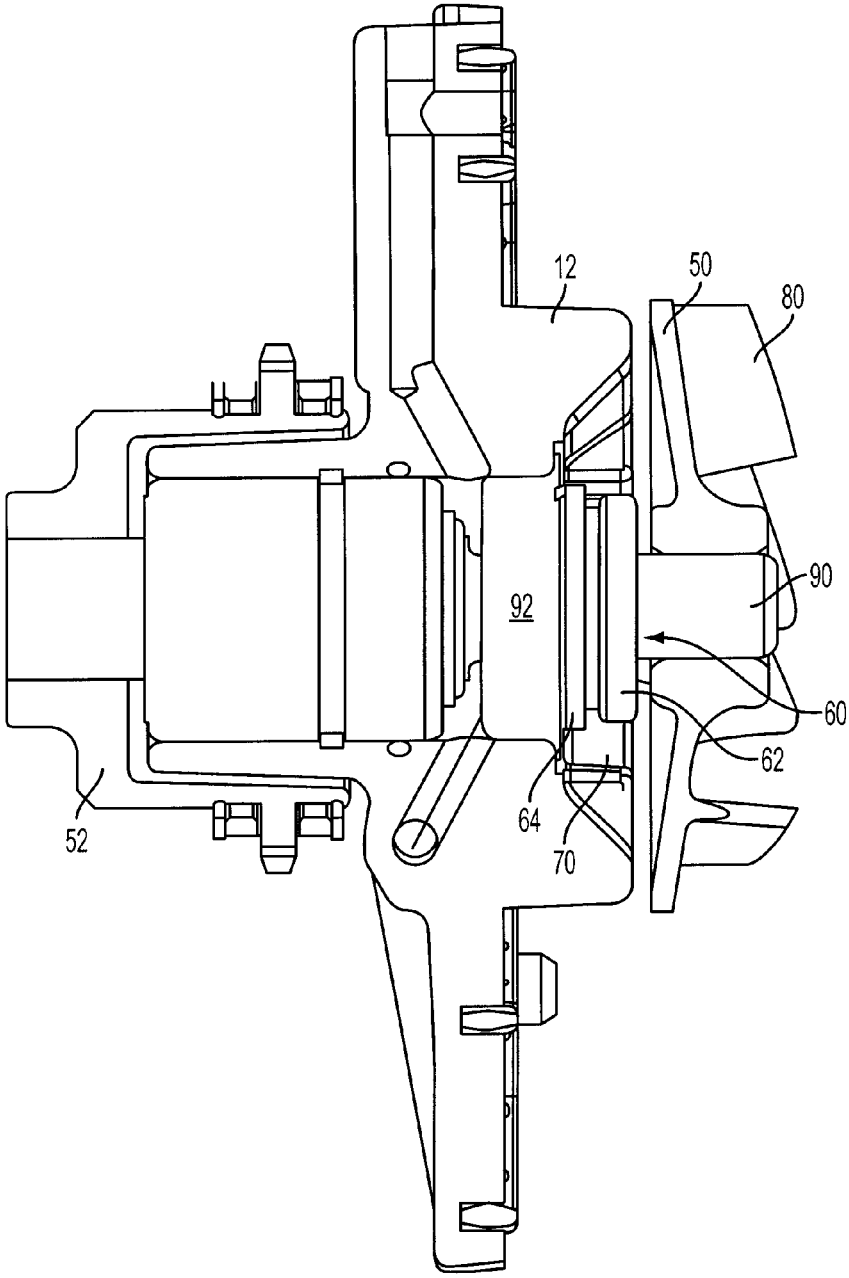
FIG. 2 is a cross-section of a water pump impeller and seal assembly according to one embodiment of the present invention.

FIG. 2 is a cross-section of a water pump assembly according to one embodiment of the present invention illustrating positioning of mechanical seal 60 inside a bowl-shaped seal cavity 70 formed in housing cover 12. Seal 60 includes an inner rotating component 62 and an outer stationary component 64. Inner rotating component 62 is mounted for rotation with shaft 90 and rotates relative to outer stationary component 64, which is mounted in housing cover 12. Inner rotating component 62 and outer stationary component 64 cooperate to substantially contain water/coolant within the pump assembly 10 except for a small amount of fluid that forms a lubricating film between sealing faces of mechanical seal 60. Impeller 50 is mounted for rotation on shaft 90, which extends from pulley 52 through bearing assembly 92 and seal 60 into chamber 34 of housing base 14 (FIG. 1). Impeller 50 includes vanes 80 on one side and is generally flat on the opposite side facing seal cavity 70. During operation, rotation of shaft 90 with impeller 50 generates frictional heat between sealing surfaces of rotating component 62 and stationary component 64 of seal 60 that must be managed for desired seal performance. Sufficient static fluid pressure surrounding the seal facilitates formation of a suitable fluid film to lubricate the sealing surfaces and reduce e friction and associated heat. In addition, low velocity circulation of water/coolant in the seal cavity provides seal cooling. As illustrated and described in greater detail below, the present invention provides design features to reduce coolant velocity and increase static pressure in seal cavity 70 to improve seal performance.

Figure 3:
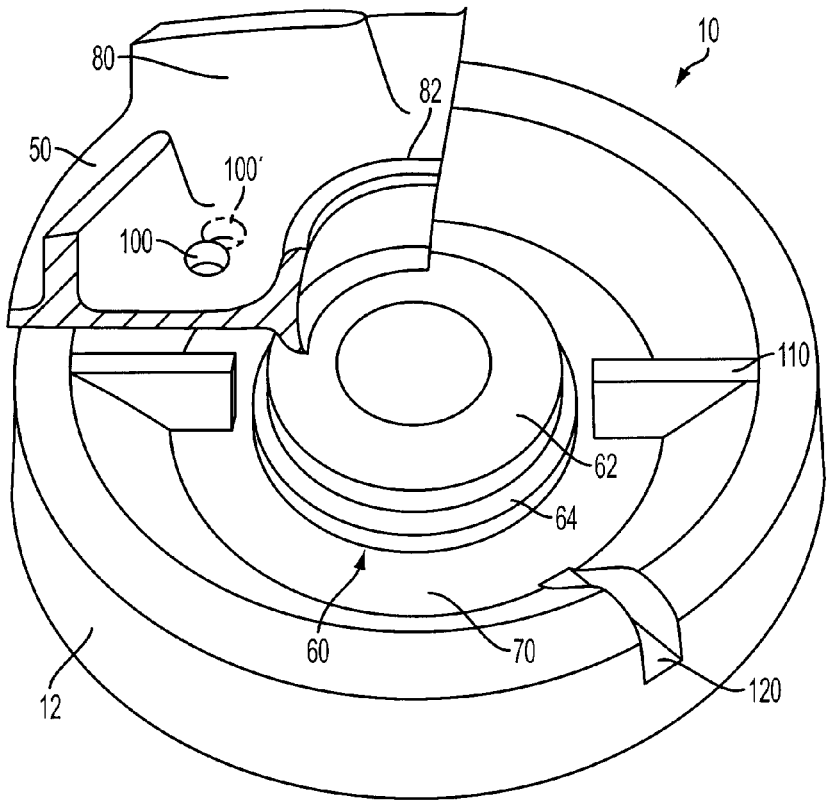
FIG. 3 illustrates positioning of vent holes on the impeller with ribs and straight radial slots in the housing according to one embodiment of the present invention.

FIG. 3 is a computer model illustrating a water pump assembly 10 with a seal cavity 70 and a cut-away view of impeller 50 illustrating one of a plurality of vent holes 100 passing from the vane side to the flat side of impeller 50 and positioned within an annular space between the impeller hub 82 and vanes 80. The diameter of vent holes 100 is selected to maintain an acceptable static pressure in seal cavity 70 while allowing vapor to escape from seal cavity 70 and return to the pump inlet. Computer simulations were used to select an appropriate diameter and positioning of vent holes with the position of vent hole 100 compared to that of an optional position 100'. In general, smaller diameters provide higher static pressure at the seal although hole location does not significantly impact static pressure. In one embodiment, three vent holes equally spaced about the circumference of impeller 50 with a diameter of 2 mm were provided. Those of ordinary skill in the art will recognize that the number, size, and positioning of vent holes may depend on the particular application and implementation.

As also shown in FIG. 3 design features in seal cavity 70 of housing cover 12 include two structures or ribs 110 extending from a periphery of the bowl-shaped cavity 70 toward seal 60. According to the present invention, positioning ribs 110 within seal cavity 70 disrupts circular coolant flow within seal cavity 70 induced by rotation of impeller 50 and improves static pressure surrounding seal 60. Computer simulations were used to determine the effect of rib position on static pressure and coolant velocity. The addition of one or more ribs to the seal cavity according to the present invention has a significant impact on the average seal pressure and provides a desirable increase in static pressure in the seal environment. Positioning of one or more ribs may vary depending upon the particular application. Factors that may be considered and that may result in a compromise in selecting an appropriate position may include the pressure rise from the inlet to the stationary part of the seal, average pressure rise, and maximum and average coolant velocities at the seal. In one embodiment, one rib 110 was positioned about 30 degrees prior to each pump outlet with another rib about 90 degrees from the first rib as measured in the direction of rotation of impeller 50.

Seal cavity 70 includes at least one radial slot 120 that fluidly couples seal cavity 70 to a surrounding annular region of the pumping chamber 34 (FIG. 1). Slots similar to slot 120 introduce high pressure coolant flow into the annular region of the pumping chamber back to seal cavity 70 to promote any existing axial or radial flow motion and to help convert total pressure to static pressure. In the illustrated embodiment, slot 120 is positioned on the periphery of seal cavity 70 and is generally radially oriented. In one embodiment, slot 120 was positioned about 15 degrees prior to each pump outlet based on the results of a computer simulation. However, computer simulations suggest that the presence of these design features or structures in any position improves static pressure at seal 60 relative to pump housings that do not have such features.

Figure 4:
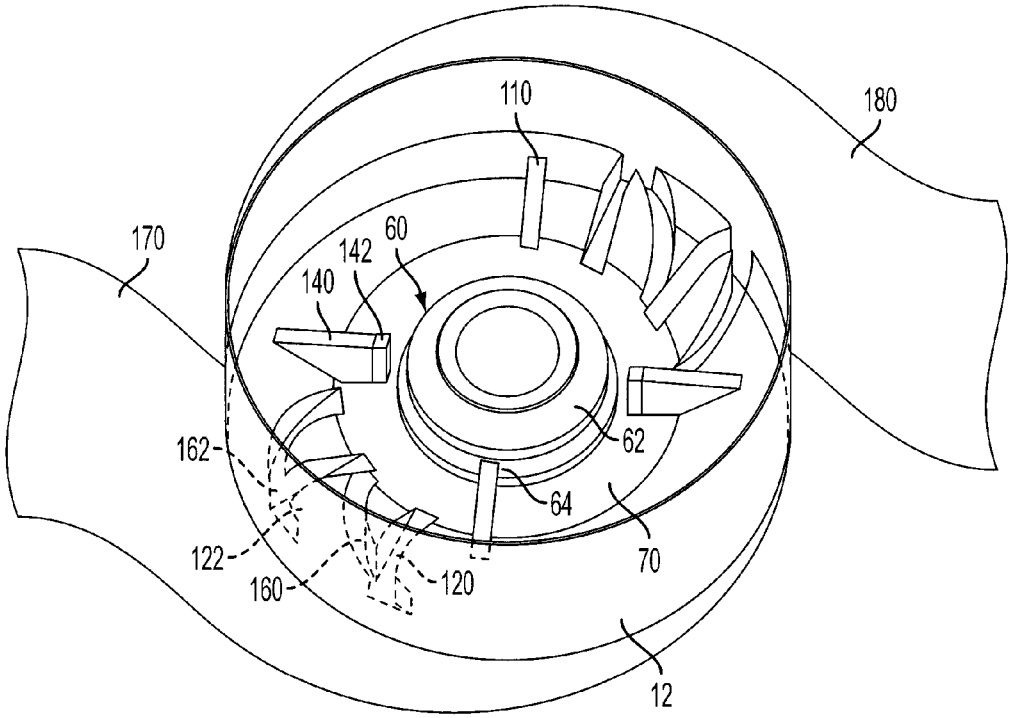
FIG. 4 illustrates alternative positioning and geometries for slots and ribs in the housing to enhance seal cavity pressure and flow characteristics according to embodiments of the present invention.

A computer model illustrating alternative positioning and geometries for design features in a pump housing to enhance pressure and flow characteristics of seal cavity 70 according to the present invention is shown in FIG. 4. The embodiments represented by the model of FIG. 4 include two pump outlets 170 and 180. Simulations were performed with a rib 110 in a first position relative to each outlet 170, 180, and then in a rotated position relative to each outlet as represented by diametrically opposed ribs 150. Additional simulations were performed with ribs having different lengths extending toward seal 60 as generally represented by a first length 140 and second length 142. Likewise, simulations were performed with a generally straight radial slot 120 in a first position relative to each outlet 170, 180 and in a second position 122 relative to each outlet 170, 180. Additional simulations were performed using a curved slot 160 in a first position and a curved slot 162 in a second location. As shown in FIG. 4, curved slots 160, 162 are curved in the direction of impeller rotation from the outside toward the inside of seal cavity 70. In general, the results of the simulations indicated that the rib length has a minimal impact on static pressure but could be used to fine tune the pressure rise from the inlet to seal 60. Longer ribs are desirable in that they generally result in lower average and maximum fluid velocities around the seal although some clearance may be required for assembly. With respect to slot orientation, the simulations indicated that the straight radial slots 120, 122 result in lower average and maximum coolant velocities around seal 60 than the curved slots 160, 162. Locating either slot geometry closer to the pump outlets 170, 180 resulted in better performance in terms of increasing static pressure around seal 60 compared to the rotated positions farther from the outlets. In one embodiment of a dual outlet pump according to the present invention, straight radial slots are positioned 30 degrees prior to each outlet with ribs positioned 30 degrees after each outlet 170, 180 and again 90 degrees later. The number and angular position of the downstream rib(s) could vary and have a similar effect. Optimum positioning for a given pump geometry could be determined by further analysis.

Figure 5:
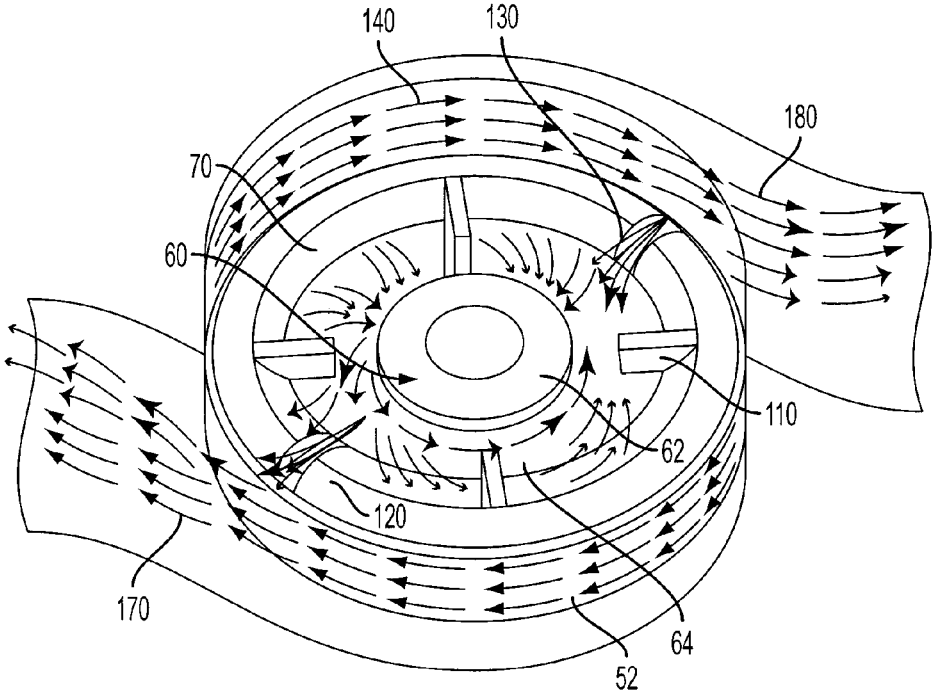
FIG. 5 illustrates positioning of ribs and two straight slots in the housing seal cavity with their effect on static pressure on the seal while disrupting the induced circular coolant flow pattern within the seal cavity of one embodiment of the present invention.

FIG. 5 illustrates coolant flow and pressure characteristics generated by a computer simulation of a water pump assembly having a housing seal cavity with design features according to the present invention. For this simulation, three equally spaced 2 mm diameter vent holes in the impeller (not shown) were used. Ribs 110 were positioned 15 degrees after each outlet 170, 180 with ribs 130 positioned 90 degrees from each rib 110, or 105 degrees after each pump outlet 170, 180. The perimeter of seal cavity 70 includes two straight slots 120 positioned 15 degrees prior to each pump outlet 170, 180.

Figure 6:
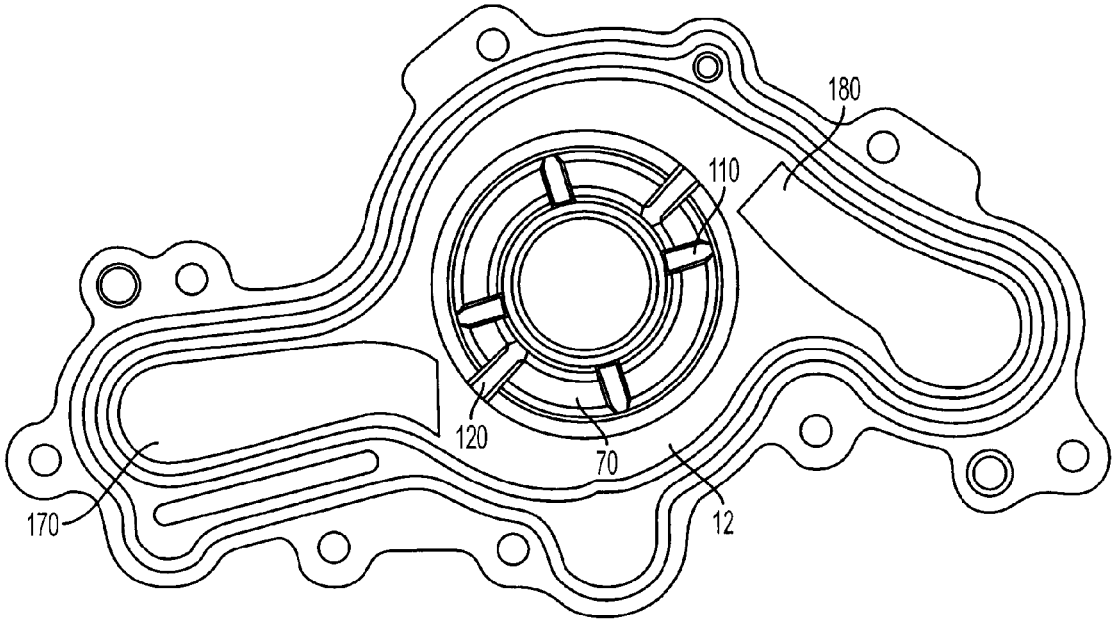
FIG. 6 is a view of a housing illustrating positioning of four ribs and two straight slots for an integrated dual outlet pump/engine block according to one embodiment of the present invention.

FIG. 6 is a plan view of a housing cover 12 illustrating positioning of four ribs 110 and two straight slots 120 in seal cavity 70 relative to pump outlets 170 and 180 according to one embodiment of the present invention. As described previously and shown in FIG. 5, straight slots 120 are positioned 15 degrees prior to each pump outlet 170 and 180, and ribs 110 are positioned such that ribs generally at 180 degrees relative to each other are positioned at 15 degrees and 105 degrees after each pump outlets 170 and 180.

As illustrated and described with reference to FIGS. 1-6, a method for improving performance of a seal mounted in a housing of a centrifugal water pump for an internal combustion engine according to the present invention includes increasing static pressure within the housing at the seal during operation of the pump to improve performance of the seal. In the illustrated embodiments, the seal is mounted in a seal cavity within the housing behind the impeller. According to one embodiment of a method for improving seal performance, a plurality of ribs are positioned within the seal cavity to disrupt circular fluid flow induced by impeller rotation and reduce fluid velocity at the seal. One or more generally radially extending slots may also be positioned about the circumference of the seal cavity to increase static pressure in the seal cavity. The present invention may also include providing a plurality of vent holes in the impeller having a diameter selected to maintain a desired static pressure at the seal.

Figure 7:
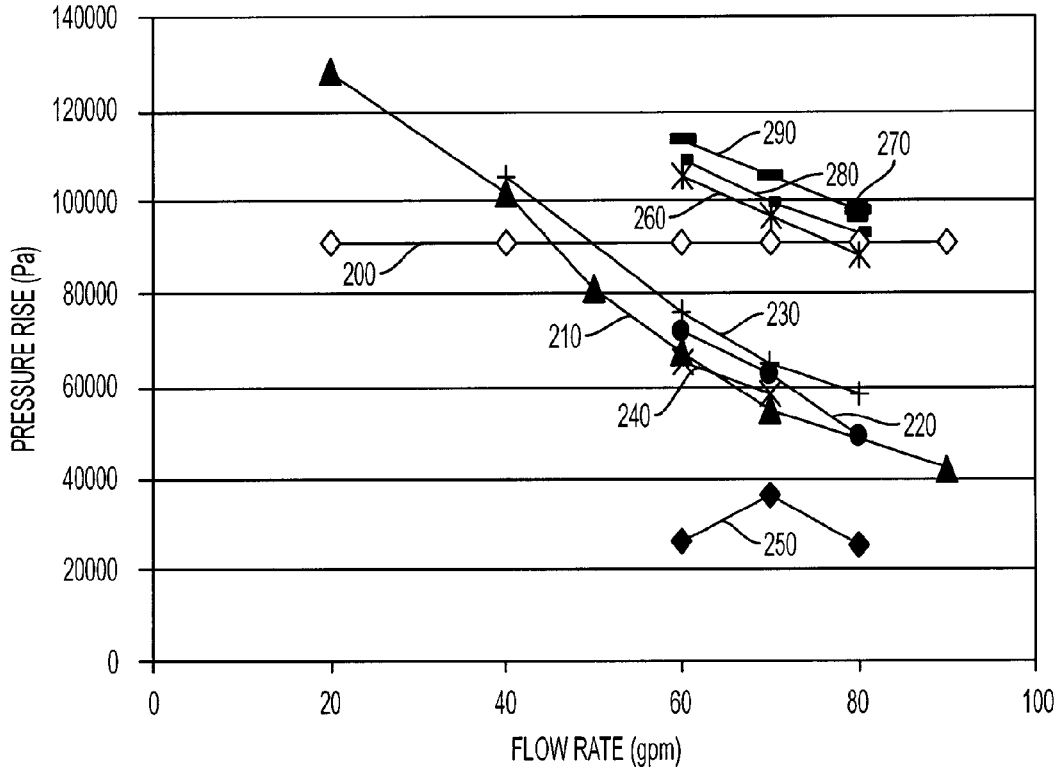
FIG. 7 is a graph showing pressure rise from the pump inlet to the stationary part of the seal as a function of flow rate attributable to various features of a water pump according to one embodiment of the present invention.

FIG. 7 is a graph showing pressure rise from the pump inlet 20 to the stationary component 64 of seal 60 as a function of flow rate attributable to various features of a water pump according to one embodiment of the present invention. The graph is based on results from computer simulations of a pump assembly 10 with selected design features illustrated and described with reference to FIGS. 1-6. The simulation used a 70 mm, 7-blade, 52 degree impeller 50. Line 200 represents a desired target pressure rise across the normal operating range for a representative application. Curve 210 represents the pressure rise of a baseline reference pump assembly that does not include any of the design features of the present invention. Curve 220 was produced by the reference pump assembly without any ribs or slots in the seal cavity, but having the impeller axially displaced toward the seal cavity of the housing by about 0.5 mm from nominal. As shown, decreasing the gap between the impeller and seal cavity marginally increased the pressure rise. Similarly, curve 230 was produced by the reference pump assembly with the impeller moved about 0.5 mm from nominal away from the seal cavity, or about 1.0 mm from the position used to generate curve 220, resulting in a slight improvement in pressure at the stationary part of the seal.

Curve 240 corresponds to the pump configuration of curve 220 with the addition of a straight radial slot in a first position relative to the pump outlet, with the impeller axially displaced from nominal away from the seal cavity to increase the gap between the seal cavity and impeller. As such, the addition of a slot causes a slight loss of static pressure at the seal when the gap between the seal cavity and impeller increases. Curve 250 illustrates the effect of adding a straight radial slot disposed in a first position in the seal cavity perimeter relative to the pump outlet for the pump configuration of curve 230, which has the impeller axially displaced to reduce the gap between the seal cavity and impeller. As illustrated by curve 250, with no ribs in the seal cavity, the addition of a slot results in a significant drop in static seal pressure when the gap between the impeller and the seal cavity of the housing decreases. Therefore, the design is less robust in that the static pressure is dependent upon the clearance or gap between the back (flat) side of the impeller and the seal cavity. However, this may be acceptable for applications or implementations where the gap or clearance is sufficiently controlled, or that can tolerate the resulting change in static pressure.

Curve 260 of FIG. 7 was generated based on an impeller with 2 mm diameter vent holes and two ribs disposed within the seal cavity at a first location relative to the pump outlet and no slots. Curve 270 was generated using an impeller with 4 mm diameter vent holes, a straight radial slot disposed at a second position closer to the pump outlet than the first position for curves 240, 250, and ribs disposed within the seal cavity at the first location. Curve 280 was generated using a configuration similar to curve 270, but with ribs moved to a second location closer to the pump outlet. Curve 290 was generated using a configuration similar to curve 280, but with 2 mm diameter vent holes in the impeller. As can be seen from the graph of FIG. 7, for this particular implementation, the design corresponding to curve 290 that combines 2 mm vent holes with appropriately positioned straight radial slots and ribs results in an increased static pressure surrounding the stationary component of the seal to improve seal performance.

Figure 8:
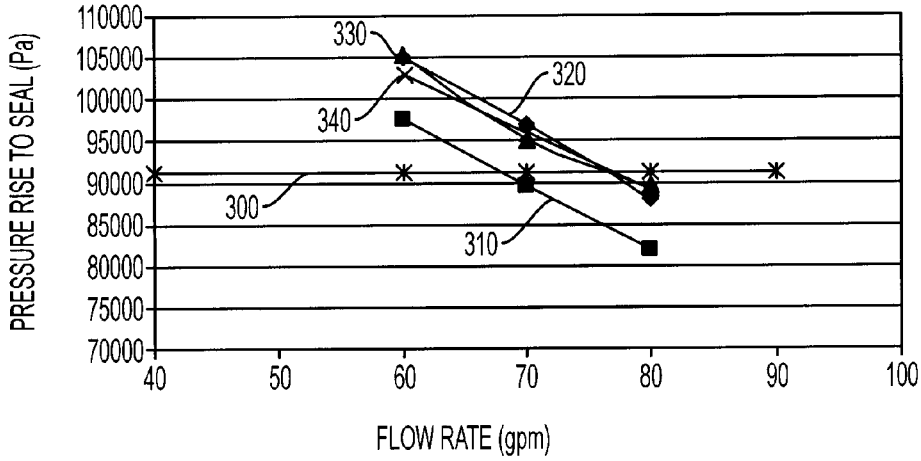
FIG. 8 is a graph showing pressure rise from the pump inlet to the stationary part of the seal as a function of flow rate attributable to various combinations of different length ribs in the seal cavity and different size vent holes in the impeller according to embodiments of the present invention.

FIG. 8 is a graph showing pressure rise from the pump inlet to the outer stationary component of the seal as a function of flow rate attributable to various combinations of rib lengths extending into the seal cavity and impeller vent hole diameters according to embodiments of the present invention. In this simulation, a 70 mm, 7-blade, 52 degree impeller was used as in the simulations illustrated and described with reference to FIG. 7. Curve 300 indicates a target pressure rise across the anticipated operating range for a representative application. Curve 310 indicates the pressure rise with a single rib at the second location and 4 mm diameter impeller vent holes. As seen in FIG. 8, curve 310 falls below the target pressure rise indicated by curve 300 as the flow rate increases past about 70 gpm. Curve 320 indicates the pressure rise with a longer single rib at the second location and 2 mm diameter impeller vent holes, which improves the pressure rise somewhat compared to curve 310. Curve 330 was produced with a similar configuration as curve 320, but with a shorter rib, which results in little or no change from curve 320. Curve 340 indicates the pressure rise with shorter ribs at the first and second locations and 4 mm vent holes, which results in some improvement in pressure rise. Based on the results illustrated in FIG. 8, the target pressure rise can not be met in this application with a single rib, although 2 mm diameter impeller vent holes improve the performance and nearly meet the target. These results suggest that 4 mm diameter impeller vent holes in combination with two properly positioned ribs should meet the target across the operating range. Of course the number of ribs, rib lengths, vent hole diameters, and rib positions for acceptable operation may vary for other applications and/or target values.

Figure 9:
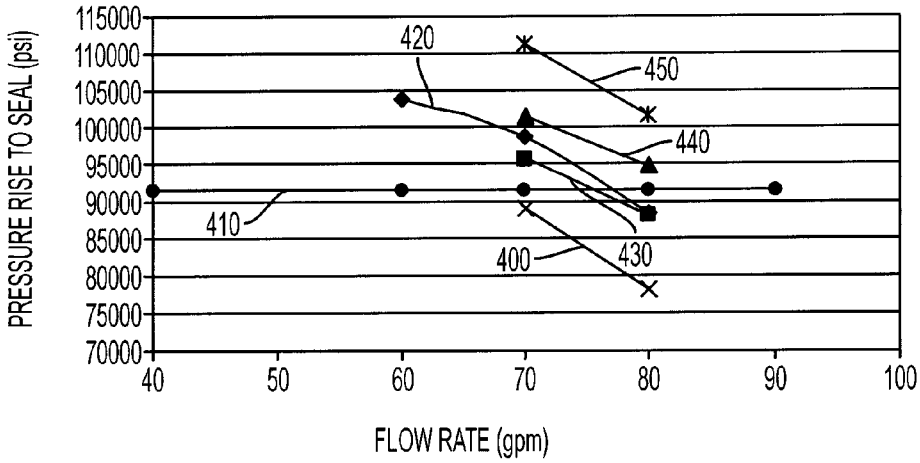
FIG. 9 is a graph showing pressure rise from the pump inlet to the stationary part of the seal as a function of flow rate attributable to various combinations of number and length of ribs and size of vent holes in the impeller according to embodiments of the present invention.

FIG. 9 is a graph showing pressure rise from the pump inlet 20 to the outer stationary component 64 of seal 60 as a function of flow rate attributable to various combinations of ribs, slots, and vent hole diameters with shorter rib lengths to provide a 38 mm diameter clearance to accommodate an assembly tool. FIG. 9 illustrates the results of a computer simulation using a 70 mm, 7-blade, 52 degree impeller. Curve 400 indicates the pressure rise with ribs in the second location and 4 mm diameter impeller vent holes, which produced a pressure rise less than a desired target indicated by line 410. Curve 420 was produced with a configuration similar to that used for curve 400, but with 2 mm diameter impeller vent holes, which improved the static pressure at the seal as indicated by the increased pressure rise from the inlet. Additional ribs positioned about 90 degrees relative to the second position were added, with 4 mm diameter impeller vent holes resulting in curve 430. Results of a similar configuration as used to produce curve 430, but with 2 mm diameter impeller vent holes are represented by curve 440. Straight radial slots were then added at the second location to the configuration used to produce curve 440 to produce curve 450. The results shown in the graph of FIG. 9 suggest that a pump configuration having 2 mm diameter impeller vent holes, straight slots, and ribs having lengths that provide a sufficient clearance to accommodate an assembly tool exceed the target pressure rise for this application and should therefore improve dynamic seal performance.

Figure 10:
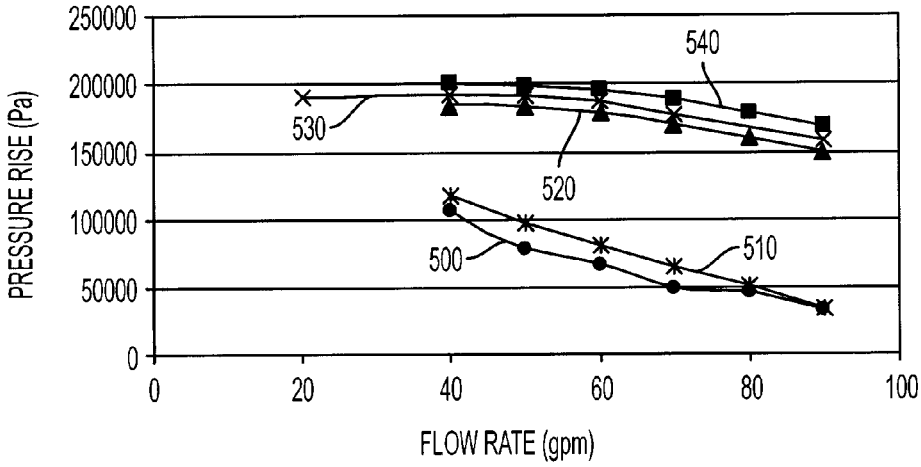
FIG. 10 is a graph showing effects of the impeller to shroud clearance on pump head and seal pressure for a conventional pump without ribs, slots, or vent holes.
Figure 11:
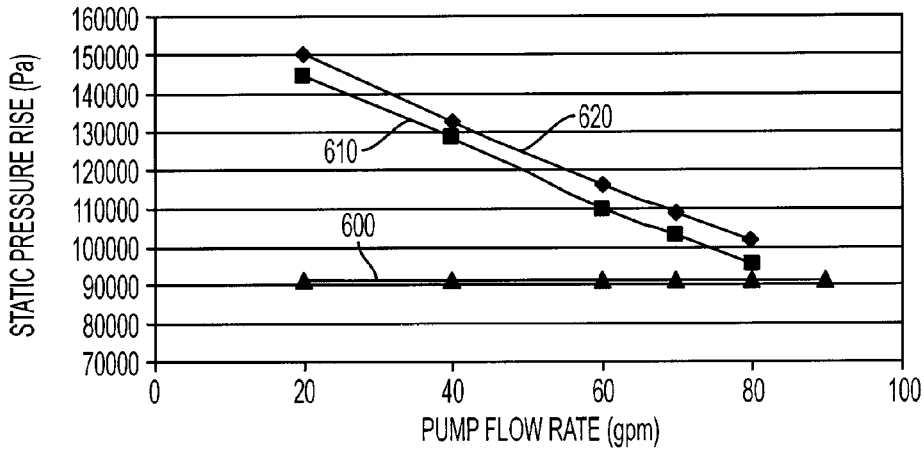
FIG. 11 is a graph showing effects of the impeller to shroud clearance for a water pump having ribs, slots, and vent holes according to embodiments of the present invention.

FIGS. 10 and 11 illustrate the improved robustness of a pump assembly incorporating features of the present invention with respect to the effect of the clearance between the impeller (vane side) and the shroud on pump head and seal pressures. The graph of FIG. 10 was generated by a computer simulation using a reference pump that did not include features for increasing static pressure and reducing coolant velocity in the seal cavity according to the present invention. The graph illustrates the sensitivity or dependence of pump head and seal pressure on the clearance between the impeller and shroud. The clearance may vary as a result of manufacturing and assembly tolerances.

In the graph of FIG. 10, curves 500 and 510 illustrate seal pressure (pressure rise from the pump inlet to the outer stationary part of the seal) as a function of flow rate for two axial impeller positions while curves 520 and 540 illustrate corresponding pump head as a function of flow rate for the same two axial impeller positions. Curve 530 represents the pressure rise for the nominal impeller position relative to the shroud. Curves 500 and 520 correspond to a larger than nominal shroud to impeller clearance, while curves 510 and 540 correspond to a smaller than nominal clearance between the impeller and shroud. The results of the simulation indicate about a 12% decrease in static pressure from the smaller to the larger clearance or about a 6% change for either axial position relative to nominal.

In the graph of FIG. 11, line 600 represents the target static pressure rise for a pump assembly having ribs, slots, and vent hole diameters selected to increase static pressure and reduce fluid velocity in the seal cavity to improve seal performance according to the present invention. Curve 610 was generated by a computer simulation with a pump having a nominal clearance between the impeller and shroud while curve 620 was generated using a pump having a larger than nominal clearance. As shown in the graph of FIG. 11, although the static pressure is still reduced somewhat when the clearance between the impeller and shroud increases in a pump according to the present invention, the clearance distance has a significantly smaller impact on seal pressure than the reference pump that does not include features of the present invention. Based on the results of the simulation shown in the graph of FIG. 11, static pressure was reduced by only about 3% for the pump with design features according to the present invention, which is about half as much variation as produced by the reference pump. As such, the design features of the present invention also improve the robustness of the pump assembly by making static pressure at the seal less sensitive to axial position of the impeller relative to the shroud within the housing.

While the best mode for carrying out the invention has been described in detail, those familiar with the art to which this invention relates will recognize various alternative designs and embodiments for practicing the invention as defined by the following claims.

What is claimed is:

1. A method for improving performance of a seal mounted in a housing of a centrifugal water pump for an engine having an impeller disposed within the housing and mounted for rotation with a shaft extending through the seal, comprising:

increasing static pressure within the housing at the seal during operation of the water pump by positioning a plurality of ribs within the seal cavity with a first rib positioned within about 30 degrees of a pump outlet as measured in the direction of rotation of the impeller, the ribs extending toward the seal to reduce fluid velocity around the seal while providing clearance between the plurality of ribs and the seal to allow fluid to flow between the ribs and the seal; and increasing static pressure within a seal cavity of the housing disposed between the impeller and the seal by positioning a plurality of generally radially extending slots about the circumference of the seal cavity, wherein at least one slot is positioned within about 30 degrees of the pump outlet.

2. The method of claim 1 wherein increasing static pressure comprises positioning a plurality of slots curved in the direction of impeller rotation within the seal cavity.

3. The method of claim 1 wherein increasing static pressure comprises positioning a plurality of holes in the impeller to allow coolant flow between the seal cavity and a vane side of the impeller.

4. The method of claim 3 wherein each of the plurality of holes is generally circular.

5. A method for improving performance of a seal mounted in a housing of a centrifugal water pump for an internal combustion engine, the water pump including an impeller disposed within the housing and mounted for rotation with a shaft extending through the seal, the method comprising:

increasing static pressure within the housing at the seal during operation of the water pump by positioning a plurality of generally radially extending slots about the circumference of the seal cavity with at least one slot positioned within about 30 degrees of a pump outlet.

6. The method of claim 5 wherein the generally radially extending slots comprise curved slots.

7. A centrifugal fluid pump for an internal combustion engine, the fluid pump comprising:

a housing having an inlet and outlet fluidly coupled to a pumping chamber; and an impeller disposed within the pumping chamber of the housing and mounted for rotation on a shaft extending into the housing through a seal, the seal having an outer stationary part mounted in the housing and cooperating with an inner rotating part mounted to the shaft to substantially contain fluid within the housing;

wherein the housing includes a bowl-shaped seal cavity surrounding the seal behind the impeller with a plurality of ribs extending from a seal cavity periphery toward the seal, the ribs positioned to disrupt circular fluid flow behind the impeller induced by impeller rotation and reduce fluid velocity around the seal with at least one rib disposed within about 30 degrees of the outlet, the housing also including at least one slot disposed within about 30 degrees of the outlet and extending through the periphery of the seal cavity and fluidly coupling the seal cavity to the pumping chamber to increase static pressure at the seal.

8. The centrifugal fluid pump of claim 7 wherein the impeller comprises a plurality of vent holes to fluidly couple a vane side to a back side of the impeller.

9. The centrifugal fluid pump of claim 8 wherein the plurality of vent holes is substantially equally spaced around the impeller.

10. The centrifugal fluid pump of claim 7 wherein the plurality of ribs are substantially equally spaced about the seal cavity.

11. The centrifugal fluid pump of claim 7 wherein the at least one slot comprises a plurality of slots and wherein at least one of the plurality of slots is positioned within about 15 degrees from the outlet.

12. The centrifugal fluid pump of claim 7 wherein each of the at least one slot extends radially outward from the seal cavity.

13. The centrifugal fluid pump of claim 7 wherein each of the at least one slot curves in the direction of rotation of the impeller.

14. The centrifugal fluid pump of claim 7 wherein each of the plurality of ribs extends to within about two millimeters of the stationary part of the seal.

15. A centrifugal water pump for an internal combustion engine, the pump comprising:

a housing having a base portion with an inlet and outlet in fluid communication with a pumping chamber including a shroud for directing fluid circulated by a shaft mounted rotating impeller from the inlet to the outlet;

a housing cover secured to the base portion, the housing cover having a bowl-shaped seal cavity with an opening adapted to receive a seal and a plurality of structures including at least one slot extending into the seal cavity positioned within about 15 degrees from the outlet and at least one rib extending from a seal cavity periphery toward the seal and positioned within about 15 degrees from the outlet and a plurality of holes in the impeller to allow coolant flow between the seal cavity and a vane side of the impeller while being sized to increase static pressure within the seal cavity to improve seal performance during operation of the pump.

16. The centrifugal water pump of claim 15 wherein the plurality of structures comprises at least one rib positioned about 15 degrees prior to the outlet as measured in the direction of impeller rotation and extending into the seal cavity to disrupt circular fluid flow in the seal cavity induced by impeller rotation.

17. The centrifugal water pump of claim 15 wherein the plurality of structures comprises a plurality of generally radially extending slots extending into the seal cavity to fluidly couple the seal cavity to surrounding portions of the pumping chamber.

18. The centrifugal water pump of claim 15 wherein the plurality of structures comprises:

a plurality of substantially equally spaced ribs extending into the seal cavity; and a plurality of substantially equally spaced slots spaced away from the ribs and fluidly coupling the seal cavity to surrounding portions of the pumping chamber.

19. The centrifugal water pump of claim 18 wherein at least one of the ribs and slots extend generally linearly radially inward toward the opening for the seal.

* * * * *